United States Patent [19]

Adams et al.

[11] 4,101,178

[45] Jul. 18, 1978

[54] LOCKING LEVER SAFETY STOP

[75] Inventors: Steven M. Adams, Indianapolis; Joseph C. Monroe, Beech Grove, both of Ind.

[73] Assignee: Herbert S. Fall, Indianapolis, Ind.

[21] Appl. No.: 837,170

[22] Filed: Sep. 28, 1977

[51] Int. Cl.[2] ..... F16C 29/00

[52] U.S. Cl. ..... 308/3.6; 312/348

[58] Field of Search ..... 308/3.6, 3.8; 312/348, 312/332, 333, 338, 341

[56] References Cited

U.S. PATENT DOCUMENTS

| | | | |
|---|---|---|---|
| 3,778,120 | 12/1973 | Hagen et al. | 308/3.8 |
| 3,901,565 | 8/1975 | Hagen et al. | 308/3.8 |

*Primary Examiner*—Trygve M. Blix
*Assistant Examiner*—Douglas C. Butler
*Attorney, Agent, or Firm*—Jenkins, Coffey & Hyland

[57] ABSTRACT

A drawer slide mechanism for detachably mounting a drawer in a cabinet includes a first slide portion for permanently mounting on the cabinet, a second slide portion slidably engaging the first slide portion, and a third slide portion for permanently mounting on the drawer. The second slide portion includes upper and lower tracks and a stop formed between the upper and lower tracks and extending into the path of motion of the third slide portion to prevent accidental withdrawal of the third slide portion therefrom. The third slide portion includes a lever having a hook portion for engaging the stop on the second slide portion. The lever is permanently mounted adjacent both of its ends from the third slide portion for slight vertical movement to provide for disengagement of the hook portion from the stop. The lever is pivotally mounted at one of its ends, and its other end includes an elongated slot which extends generally transverse to the direction of drawer motion. The third slide portion includes a pin which extends through the slot, the pin having a circular cross section to allow the slight vertical movement. To remove the third slide portion from the second, the lever is moved slightly upwardly so that the hook disengages the stop and the drawer can be removed.

15 Claims, 4 Drawing Figures

LOCKING LEVER SAFETY STOP

This invention relates to drawer slide hardware and particularly to a drawer slide mechanism which has a locking safety stop preventing accidental sliding of the drawer off its tracks, the safety stop mechanism being actuable, however, to allow the drawer to be disengaged from the slide mechanism and the cabinet to which it is mounted.

There are several well-known types of multiple-member slide mechanisms which include stops to prevent accidental disengagement of a drawer upon which the slide mechanism is mounted from the slide mechanism and the cabinet to which it is attached. See, for example, Hagen et al, U.S. Pat. No. 3,778.120; and Hagen et al, U.S. Pat. No. 3,901,565. These patents disclose vertically and horizontally movable locking latch mechanisms to prevent accidental removal of a drawer from the slide mechanism to which it is mounted. These locking levers are relatively complex and allow no movement between the drawer on which they are mounted and adjacent slide mechanism components.

It is an object of the present invention to provide a simplified locking lever to prevent accidental disengagement of a drawer from a multi-member drawer slide mechanism.

According to the invention, a drawer slide mechanism includes a first slide member, a second slide member slidably engaging the first slide member, the first slide member including means for providing a stop which projects outwardly from the first slide member and the second slide member including a lever movably mounted thereon and having a hook portion for engaging the stop to prevent disengagement of the second slide member from the first. The lever has first and second ends, and is provided with an elongated slot adjacent the first end thereof. A pin is provided for movably attaching the slotted end of the lever to the second slide member to provide for limited movement of the lever to disengage the hook from the stop and allow the second slide member to be disengaged from the first. The long dimension of the slot extends generally perpendicularly to the direction of travel of the drawer. The second end of the lever is pivotally mounted on the second slide member.

In the illustrative embodiment, the lever comprises a generally flat strip having a top edge, a bottom edge, and two end edges. The first and second hook portions are provided by a generally Z-shaped second flat strip attached in face-to-face relation to the first-mentioned strip. The ends of the Z-shaped flat strip project slightly above and below the vertically upper and lower edges of the first-mentioned strip to form the hook portion. The Z-shaped strip can be attached to the first-mentioned strip on either of the two faces thereof.

In the illustrative embodiment, the first slide member includes two stops formed a distance apart adjacent a transverse edge thereof. The distance between the two stops is sufficient to allow passage of the lever therebetween as the first slide member and second slide member move relative to one another.

The invention may best be understood by referring to the following description and accompanying drawings which illustrate the invention. In the drawings.

Figures 1, 2, 3, 4:
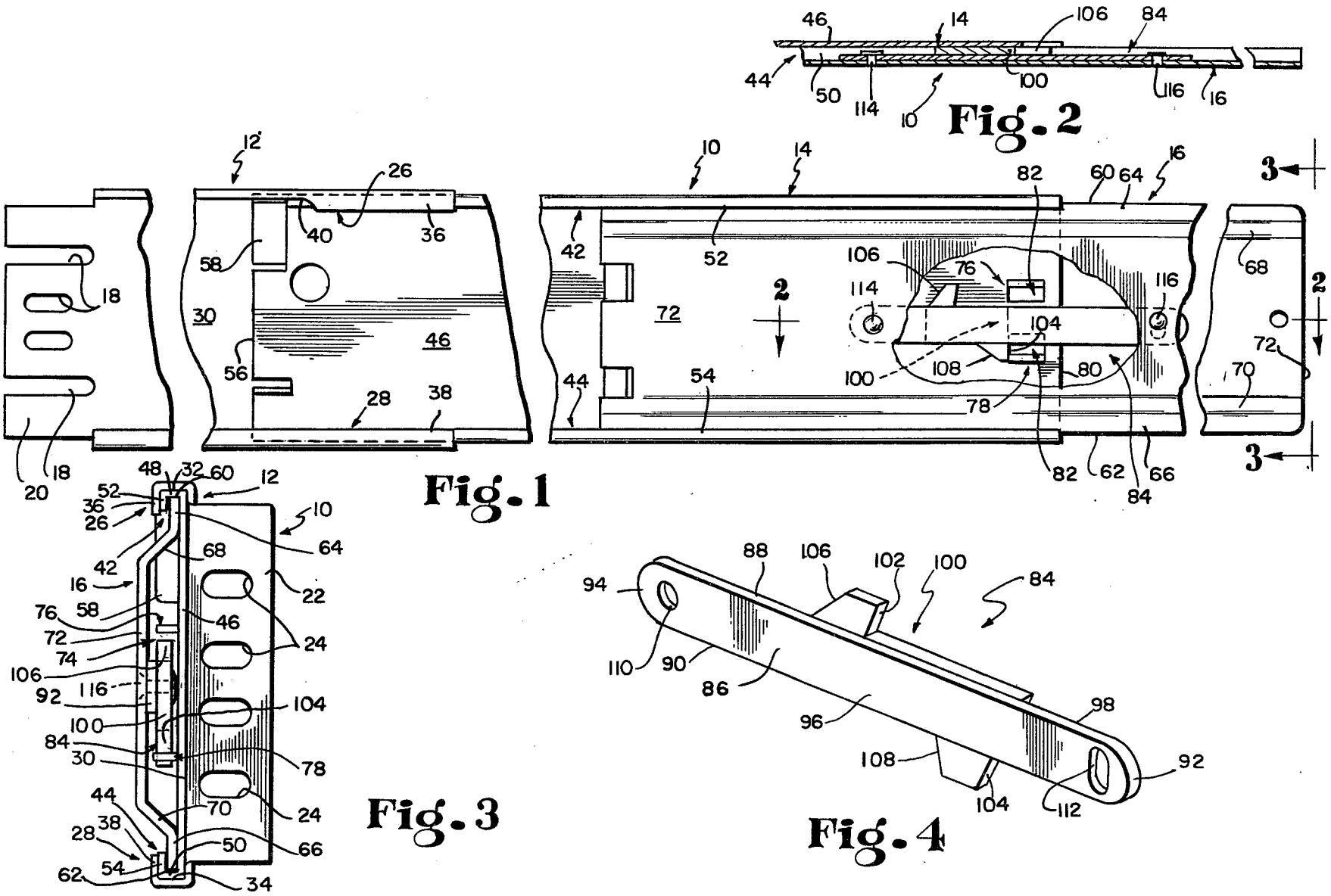
FIG. 1 is a fragmentary side elevational view, partly broken away, of a drawer slide mechanism constructed according to the present invention.
FIG. 2 is a fragmentary sectional view taken generally along section lines 2—2 of FIG. 1.
FIG. 3 is an end elevational view, along section lines 3—3 of FIG. 1.
FIG. 4 is a perspective view of a detail of the mechanism of FIGS. 1-3.

Referring now to FIGS. 1, 3, there is illustrated a drawer slide mechanism 10 including first, second and third track members or slide portions 12, 14, 16, respectively. The first slide portion 12 is an inner slide portion for rigid mounting upon a cabinet (not shown). For this purpose, a plurality of slots 18 are provided on a tab or ear 20 at the rearward end of slide portion 12. With reference to FIG. 3, an additional tab or ear 22 having a plurality of slots 24 is provided at the forward or outer end of slide portion 12. Slots 18, 24 receive screws or other means (not shown) for attaching slide portion 12 to the cabinet.

Slide portion 12 includes upper and lower generally U-shaped facing channels or tracks 26, 28. Tracks 26, 28 are formed by bending the opposed longitudinal edges of the generally flat central portion 30 of slide portion 12 first perpendicular to flat portion 30 to form the floors 32, 34 of tracks 26, 28, respectively, and then parallel to flat portion 30 and toward one another as at 36, 38 to form the tracks 26, 28, respectively. Wall 36 is notched or cut away as best seen at reference numeral 40 in FIG. 1.

Tracks 26, 28 receive a pair of tracks 42, 44, respectively of middle slide portion 14. As with inner slide portion 12, tracks 42, 44 are formed by first forming the opposite longitudinal edges of the generally flat central portion 46 of middle slide portion 14 perpendicular to central portion 46 to form the floors 48, 50, respectively of tracks 42, 44 then forming the opposite longitudinal edges parallel to central portion 46 and toward one another as at 52, 54, respectively, to provide tracks 42, 44. After middle slide portion 14 is mounted in inner slide portion 12, a portion of slide portion 14 adjacent the rearward edge 56 (FIG. 1) of slide portion 14 is deformed outwardly as at 58 to engage notch 40 when slide portion 14 is projected outwardly from slide portion 12 to the full extent of its travel. This deformed region or tab 58 engaging the notch 40 prevents accidental disengagement of the middle slide portion 14 from the inner slide portion 12.

Outer slide portion 16 includes two opposed, longitudinally extending edges 60, 62 which are slidably received in tracks 42, 44, respectively. Slide portion 16 includes portions 64, 66 adjacent edges 60, 62, respectively, which lie generally flat against central portion 46 of slide portion 14. Between edge portions 64, 66, slide portion 16 is formed outwardly away from central portion 46 with two oblique, longitudinally extending wall portions 68, 70 and a generally flat portion 72 therebetween to define a space 74 between flat portions 46 and 72 of slide portions 14, 16, respectively. Flat portion 72 lies outwardly from portion 46 a sufficient distance so that portion 72 can be mounted against the side of a drawer for free movement of the drawer without interference between the side of the drawer and walls 36, 38 of inner slide portion 12. Further, space 74 is provided to house the stop mechanism of the invention.

The stop mechanism includes a pair of stops 76, 78 formed from flat portion 72 of slide portion 14. As best illustrated in FIGS. 1, 3, stops 76, 78 are provided by forming openings 82 in flat portion 72 near edge 80 and bending longitudinally extending edges defining openings 82 generally perpendicularly to flat portion 46 into space 74. The stop mechanism further includes a stop lever 84 best illustrated in FIG. 4. The illustrative lever 84 includes a flat elongated strip of material 86 having two opposite longitudinal edges 88, 90, two opposite transverse (end) edges 92, 94 and two oppositely facing sides 96, 98. Illustratively, a second, somewhat Z-shaped strip of material 100 is welded or otherwise attached to side 98 of strip 86. This construction is suitable for a right-hand drawer slide. Strip 100 includes two generally vertically extending hook faces 102, 104 both of which face the outer end of the slide mechanism. Strip 100 additionally includes two camming surfaces 106, 108 adjacent faces 102, 104, respectively. Faces 102, 104 and camming surfaces 106, 108 are provided in the generally longitudinally extending edges of strip 100. Strip 86 includes a circular hole 110 at its inner end and a slot 112 adjacent its outer end. The long dimension of slot 112 extends generally vertically (transverse to the direction of drawer movement). Lever 84 is permanently attached by rivet 114 through hole 110 and rivet 116 through slot 112 to the flat portion 72 of slide portion 16 to extend into space 74. Such attachment allows pivotal movement of lever 84 about rivet 114, the engagement of rivet 116 in slot 112 giving the outer end of lever 84 limited vertical movement.

When the outer end of lever 84 is in its lowermost position (illustrated in FIGS. 1, 3) face 104 engages stop 78 as slide portion 16 is projected to its full extension with respect to slide portion 14. This stopping action prevents inadvertent disengagement of slide portion 16 from slide portion 14 as the drawer is moved outwardly from the cabinet. To disengage the drawer from the slide mechanism, it is necessary to move the outer or forward end of lever 84 manually upward on rivet 116 until face 104 disengages from stop 78. This will permit slide portion 16 to advance forward until face 102 engages stop 76. It is then necessary to move the outer or forward end of lever 84 manually downward on rivet 116 until face 102 disengages from stop 76. Outer slide portion 16 can then be removed from intermediate slide portion 14 and the drawer, with slide portion 16 attached thereto, can be removed. To reengage the intermediate and outer slide portions 14, 16, it is necessary only to engage edges 60, 62 of outer slide portion 16 with tracks 42, 44, respectively, of intermediate slide portion 14. When the drawer is urged back into the cabinet, camming surface 106 will urge the outer end of lever 84 downwardly on pin 116 in the event lever 84 should become stuck in the upward position to insure that face 104 will engage stop 78. Camming surface 108 encounters the forward end of stop 78 which urges the forward end of lever 84 upward over stop 78 to reengage the stop mechanism.

It will be appreciated that with the structures of strips 86, 100 of the disclosed embodiment, the lever 84 can be constructed for use on a left-hand drawer slide by spot welding or otherwise attaching strip 100 to side 96 of strip 86.

It should further be understood that, while the slide assembly illustrated is a solid-bearing slide assembly, the apparatus of the instant invention can be applied equally as well to a ball- or roller-bearing slide assembly or a combination ball-and/or roller-bearing and solid bearing slide assembly,

What is claimed is:

1. A drawer slide mechanism including a slide member, another slide member slidably engaging the first-mentioned slide member, the first-mentioned slide member including means for providing a stop which projects outwardly from the first-mentioned slide member, and the other slide member including a lever movably mounted thereon and including a hook portion for engaging the stop to limit movement of the other slide member with respect to the first-mentioned slide member, the lever including first and second ends, the lever being provided with a slot adjacent the first end thereof, and means for movably attaching the slotted end of the lever to the other slide member to provide for limited movement of the lever to disengage the hook from the stop and allow the other slide member to be disengaged from the first-mentioned slide member.

2. The apparatus of claim 1 wherein the second end of the lever is pivotally mounted on the other slide member.

3. The apparatus of claim 2 wherein the lever is provided with a second hook portion, the second hook portion disposed on the lever to extend oppositely from the first-mentioned hook portion.

4. The apparatus of claim 3 wherein the lever comprises a generally flat strip having a top edge, a bottom edge, and two end edges and a generally Z-shaped second flat strip attached in fact-to-face relation to the first-mentioned strip to provide the first and second hook portions, the ends of the Z-shaped flat strip projecting slightly above and below the vertically upper and lower edges of the first-mentioned strip.

5. The apparatus of claim 4 wherein the long dimension of the slot extends generally perpendicular to the directions of travel of the drawer.

6. The apparatus of claim 1 wherein the first-mentioned slide portion is an intermediate slide portion, the other slide portion is an outer slide portion for substantially permanent attachment to a drawer, and further including an inner slide portion for slidably engaging the intermediate slide portion, the inner slide portion for rigid attachment to a cabinet with respect to which the drawer is slidably and removably mounted.

7. A drawer slide mechanism including a first slide portion for rigidly mounting on a cabinet, a second slide portion slidably engaging the first slide portion, and a third slide portion for permanently mounting on the drawer, the third slide portion slidably and removably engaging the second slide portion, the second slide portion including a stop for preventing accidental withdrawal of the third slide portion therefrom, and the third slide portion including a lever having a hook portion for engaging the stop on the second slide portion, the lever having two ends and being permanently mounted adjacent both ends from the third slide portion for slight vertical movement to provide for disengagement of the hook portion from the stop for removal of the third slide portion from the second portion and the drawer from the cabinet.

8. The apparatus of claim 7 wherein the lever extends generally longitudinally of the drawer slide apparatus, the lever being pivotally mounted adjacent one of its ends from the third slide portion.

9. The apparatus of claim 8 wherein the lever includes means defining a slot for providing for movement of the lever about the pivot axis for a short distance, and the third slide portion includes a motion-limiting pin which extends through the slot for limited pivotal movement of the lever about the pivot axis to disengage the hook from the stop.

10. The apparatus of claim 9 and further including a second hook portion on the lever, the second hook portion being disposed on an opposite edge of the lever from the first-mentioned hook portion.

11. A drawer slide mechanism including a slide member, another slide member slidably engaging the first-mentioned slide member, the first-mentioned slide member including means for providing a stop which projects outwardly from the first-mentioned slide member, and a lever permanently and movably mounted on the other slide member, the lever having a hook portion for engaging the stop on the first-mentioned slide member to limit movement of the other slide member with respect to the first-mentioned slide member, the lever including first and second ends and being mounted for slight vertical movement to provide for disengagement of the hook portion from the stop for removal of the other slide member from the first-mentioned slide member.

12. The apparatus of claim 11 wherein the lever is pivotally mounted from the other slide member adjacent one end of the lever, and the other end of the lever includes a slot which extends generally transversely to the direction of movement of the drawer, the other slide member including a generally circular cross-section pin for passage through the slot and movable attachment of the second end of the lever to the other slide member.

13. The apparatus of claim 12 wherein the lever is provided with a second hook portion, the second hook portion disposed on the lever to extend oppositely from the first-mentioned hook portion.

14. The apparatus of claim 13 wherein the lever comprises a generally flat strip having a top edge, a bottom edge and two end edges, and a generally Z-shaped second flat strip attached in face-to-face relation with the first-mentioned strip to provide the first and second hook portions, the hook providing portions of the Z-shaped flat strip projecting slightly above and below the vertically upper and lower edges of the first-mentioned strip.

15. The apparatus of claim 14 wherein the first-mentioned slide member includes means for providing a second stop which projects outwardly from the first-mentioned slide member and is spaced apart transversely of the direction of drawer movement from the first-mentioned stop a sufficient distance to provide for passage of the lever longitudinally of the direction of drawer movement therebeween as the drawer slide mechanism is moved toward its fully retracted position, the lever including camming surfaces actuable by the first and second stops to move the lever first upwardly and then downwardly to permit it to pass between the stops as the slide mechanism is moved toward its retracted position.

* * * * *